US008678024B2

(12) United States Patent
Freiler

(10) Patent No.: US 8,678,024 B2
(45) Date of Patent: Mar. 25, 2014

(54) VENTING CAP ASSEMBLY

(76) Inventor: John Freiler, Somerset, NJ (US)

( * ) Notice: Subject to any disclaimer, the term of this patent is extended or adjusted under 35 U.S.C. 154(b) by 293 days.

(21) Appl. No.: 13/090,136

(22) Filed: Apr. 19, 2011

(65) Prior Publication Data

US 2011/0253221 A1 Oct. 20, 2011

Related U.S. Application Data

(60) Provisional application No. 61/325,572, filed on Apr. 19, 2010.

(51) Int. Cl.
*F16K 17/14* (2006.01)

(52) U.S. Cl.
USPC ..... 137/72; 220/89.1; 220/315

(58) Field of Classification Search
USPC ..... 137/72; 138/89; 220/201, 315, 89.1
See application file for complete search history.

(56) References Cited

U.S. PATENT DOCUMENTS 5,791,367 A 8/1998 Hackman et al.
6,145,530 A 11/2000 Fernandez
6,619,497 B2 * 9/2003 Freiler ..... 220/201

* cited by examiner

*Primary Examiner* — Kevin Lee
*Assistant Examiner* — Macade Brown
(74) *Attorney, Agent, or Firm* — The Compton Law Firm, PC; Scott D. Compton

(57) ABSTRACT

The present application is directed to an assembly for sealing an opening of a container, comprising (1) a first member operationally configured to connect to the container at the opening; (2) a second member operationally configured to abut the first member in a manner effective to cover the opening of the container; and (3) a temperature-sensitive fastening means operationally configured to releasably secure the second member to the first member in a manner effective to form a seal there between; wherein at least part of the fastening means is positioned apart from the second member.

12 Claims, 9 Drawing Sheets

VENTING CAP ASSEMBLY

CROSS-REFERENCE TO RELATED APPLICATIONS

The application is entitled to the benefit of the filing date of the prior-filed provisional application No. 61/325,572, filed on Apr 19, 2010.

STATEMENT REGARDING FEDERALLY SPONSORED RESEARCH OR DEVELOPMENT

Not applicable.

FIELD OF THE APPLICATION

The application relates generally to a cap for venting a container under pressure.

BACKGROUND

Fusible venting caps are used for pressure relief venting of tank containers such as trailer tanks, bulk tanks, and storage tanks storing fluids therein. Generally, venting caps are designed to vent containers to the atmosphere and prevent tank explosions that may otherwise be caused by fluid expanding within the sealed tank when the tank reaches a particular temperature or is exposed to heat.

Known fusible caps typically include an outer annular nut for connecting to a tank, an inner circular central disc piece, and an intermediate annular ring of a fusible low melt alloy intermediate or a polymer-based material which softens in response to externally applied heat. During venting, the inner circular central disc piece is blown out from the outer nut once the annular ring material softens or melts. Due to the design of known caps, once the inner circular central disc piece is blown out the entire cap must be replaced.

A need exists for a reusable fusible venting cap.

SUMMARY

The present application is directed to an assembly for sealing an opening of a container, comprising (1) a first member operationally configured to connect to the container at the opening; (2) a second member operationally configured to abut the first member in a manner effective to cover the opening of the container; and (3) a temperature-sensitive fastening means operationally configured to releasably secure the second member to the first member in a manner effective to form a seal there between; wherein at least part of the fastening means is positioned apart from the second member.

The present application is also directed to an assembly for venting a fluid container, comprising (1) a first member operationally configured to connect to a vent nipple of the container; (2) a second member operationally configured to cover the vent nipple; and (3) one or more temperature-sensitive fasteners including yieldable members, the fasteners being operationally configured to releasably secure the second member to the first member in a manner effective to form a seal at the vent nipple, the yieldable members being positioned apart from the second member.

The present application is also directed to a method of venting a fluid container, comprising the following steps: (1) providing an assembly including (a) a first member operationally configured to connect to a vent nipple of the container, (b) a second member operationally configured to abut the first member and cover the vent nipple, and (c) a first set of one or more temperature-sensitive fastening assemblies operationally configured to secure the second member to the first member in a manner effective to form a seal there between thereby sealing the vent nipple; each of the one or more temperature-sensitive fastening assemblies having a fusible member constructed from a polymeric material effective to maintain its original shape up to a maximum predetermined temperature, each fusible member being positioned apart from the second member; (2) connecting the assembly to a vent nipple of a fluid container to seal the vent nipple, wherein once the temperature of the assembly goes above the maximum predetermined temperature, the pressure of the fluid container is effective to remove the second member from the first member, the first member maintaining its connected orientation with the vent nipple; and (3) placing the second member in abutment with the first member and sealing the vent nipple via a second set of one or more temperature-sensitive fastening assemblies.

BRIEF DESCRIPTION

Figure 1:
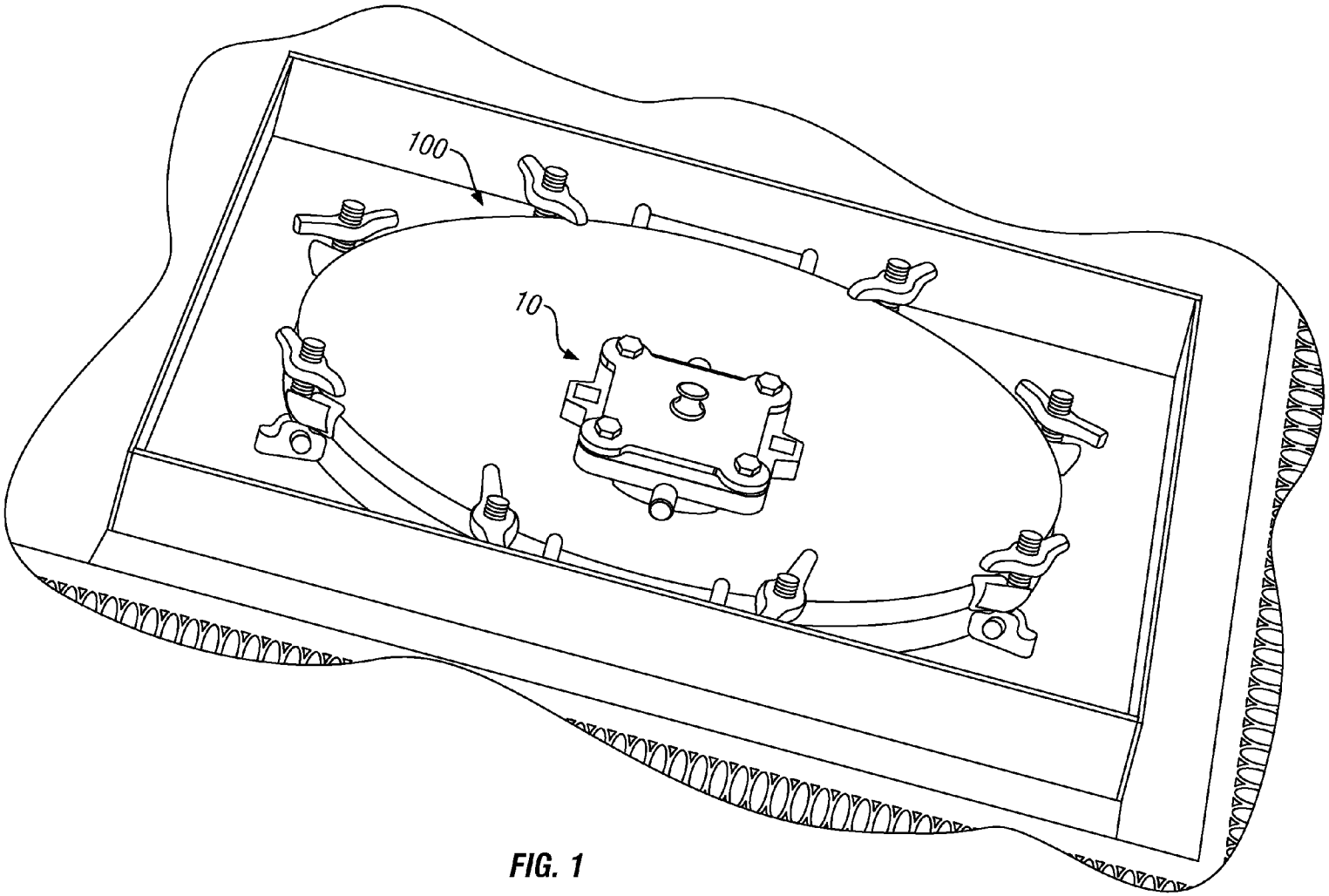
FIG. 1 is a perspective environmental top view of an embodiment of the venting cap assembly of the present application as attached to a tank container.

It has been discovered that a fusible venting cap may be configured in a manner effective for on location reassembly of the cap after venting of a tank container, thereby, eliminating the necessity of having to replace the cap for further venting purposes. Heretofore, such a desirable achievement has not been considered possible, and accordingly, the assembly and methods of this application measure up to the dignity of patentability and therefore represent a patentable concept.

Before describing the invention in detail, it is to be understood that the present assembly and method are not limited to particular embodiments. It is also to be understood that the terminology used herein is for the purpose of describing particular embodiments only, and is not intended to be limiting. As used in this specification and the appended claims, the terms "container," "tank container" and like terms refer to any vessel for storing fluid under pressure and/or at ambient pressure. As used herein, the term "temperature-sensitive" refers to a tendency of a material to melt, liquefy or deform at temperatures greater than about 121° C. (about 250° F.). As used herein, the verb "vent" and like terms refer to the discharge of fluid out from a pressurized fluid container through an opening of a fluid container.

In one aspect, the application provides a fusible venting cap assembly that may be repaired at the point of tank ventilation without necessarily removing the nut portion of the cap from the tank during repair.

In another aspect, the application provides a square seal lug sized to accept a standard ½ inch drive socket to allow for close quarters tightening or loosening of the fusible venting cap assembly.

In another aspect, the application provides a fusible venting cap assembly for sealing a tank vent, the assembly having (1) a threaded member for connecting to the tank vent at the tank out nipple, and (2) a substantially planar member for covering the vent, the planar member being releasably securable to the threaded member at one or more points clear of or outside of the periphery of the tank vent.

In another aspect, the application provides a fusible venting cap assembly operationally configured to seal a container housing volatile liquid up to a temperature of about 121° C. (about 250° F.).

In another aspect, the application provides a fusible venting cap assembly including one or more fusible fastening assemblies operationally configured to maintain a seal about a tank container vent up to a predetermined temperature.

In another aspect, the application provides a fusible venting cap assembly including one or more fastening assemblies having fusible elements constructed from one or more polymeric materials.

In another aspect, the application provides a fusible venting cap assembly including one or more yieldable members constructed from one or more polymeric materials, the cap assembly being effective for venting a tank container and the one or more yieldable members being located clear of or outside of the periphery of the tank container vent.

In another aspect, the application provides a fusible venting cap assembly operationally configured to seal a tank vent for an indefinite period of time up to temperatures of about 100° C. (about 212° F.).

In another aspect, the application provides a fusible venting cap assembly effective to withstand brief exposure to an internal pressure up to about 2068427 Pascal (about 300 PSI) without being damaged or failing.

In another aspect, the application provides a fusible venting cap assembly including one or more fastening assemblies having fusible elements constructed from one or more polymeric materials, the fusible venting cap assembly being operationally configured to seal a container under pressure up to a desired ambient temperature of the cap assembly as determined by the configuration and materials of construction of the fusible elements.

In another aspect, the application provides a fusible venting cap assembly including one or more yieldable members constructed from one or more polymeric materials, the fusible venting cap assembly being operationally configured to seal a container under pressure up to a desired ambient temperature of the cap assembly as determined by the configuration and materials of construction of the yieldable member(s).

In another aspect, the application provides a fusible venting cap assembly that may be left attached to a tank container during tank cleaning, including cleaning using high temperature cleaning fluid such as steam cleaning.

In another aspect, the application provides a fusible venting cap assembly operationally configured to withstand exposure to one or more external chemicals without failing.

In another aspect, the application provides a fusible venting cap assembly including mating members having substantially planar surfaces effective to form a seal there between. In another embodiment, the mating surfaces of the assembly may include non-planar surfaces effective to form a seal there between.

In another aspect, the application provides a fusible venting cap assembly including one or more yielding members constructed from one or more polymeric materials effective for maintaining a seal of a tank container vent up to a temperature of about 121° C. (about 250° F.).

In another aspect, the application provides a fusible venting cap assembly that may be tightened using a hammer without failing prematurely due to damage caused by exterior hammer impacts in like manner as other venting caps that have an intermediate annular ring of a fusible low melt alloy intermediate or a polymer-based material.

In another aspect, the application provides a venting cap tested and marked in accordance with DOT MC306 and MC307 requirements as of the date of this application.

In another aspect, the application provides a venting cap manufactured in accordance with C.F.R.178.342-4 for use on MC307 tank trailers as of the date of this application.

Discussion of the Assembly and Method

To better understand the novelty of the invention and methods of use thereof, reference is hereafter made to the accompanying drawings. With reference to FIG. 1, a simplified fusible venting cap assembly 10 (hereafter "assembly") operationally configured to be releasably secured to a tank container 100 is provided. Suitably, the assembly 10 is operationally configured to seal a tank container 100 under pressure until the assembly 10 reaches a predetermined maximum temperature.

Figure 2A:
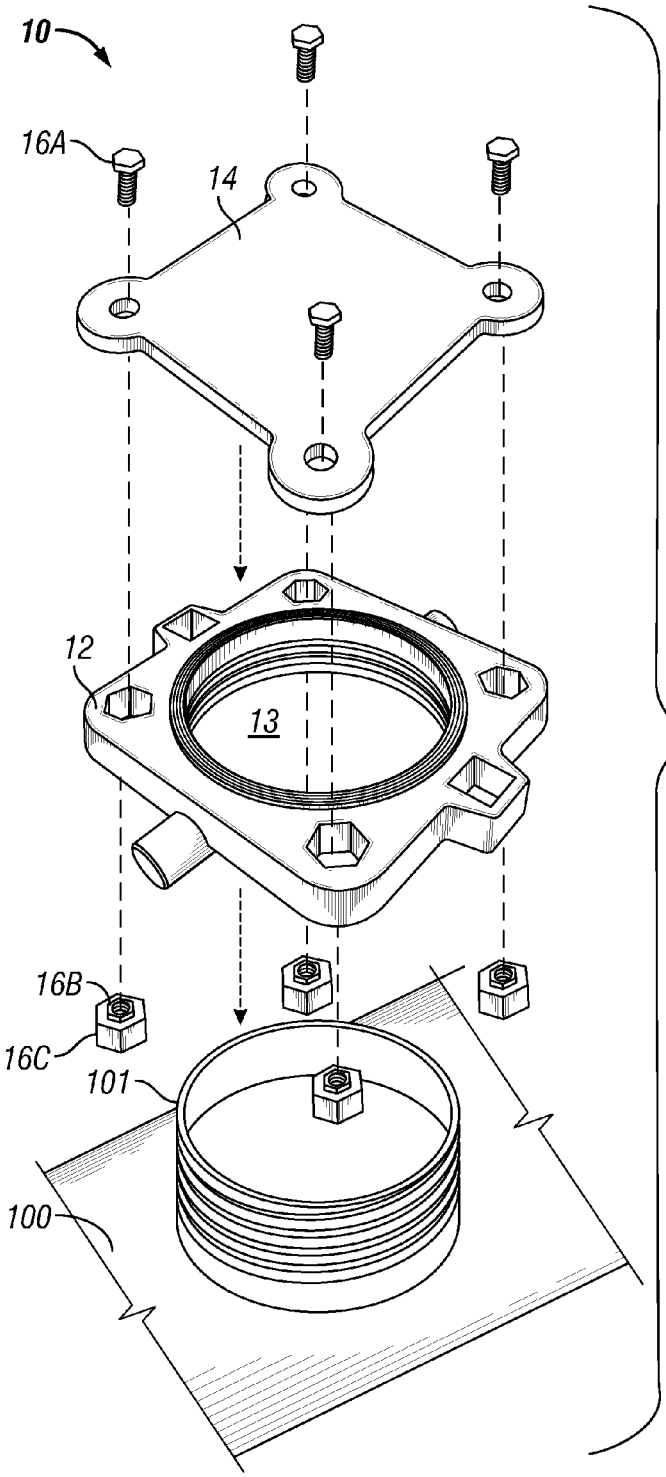
FIG. 2A is an exploded view of an embodiment of the venting cap assembly.
Figure 2B:
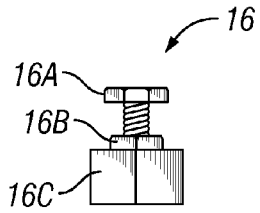
FIG. 2B is a side view of an embodiment of an assembled fastening assembly.

The various components of the assembly 10 are depicted in FIGS. 2A and 2B. Suitably, the assembly 0 includes a nut member 12, a planar member 14, and a fastening means including one or more fastening assemblies 16. In operation, the nut member 12 (hereafter "nut") is operationally configured to releasably secure to a vent nipple 101 of a tank container 100. The planar member 14 is operationally configured to abut the nut 12 acting as a cover plate of the assembly 10 covering the opening of the vent nipple 101 and at least part of the nut 12. In a suitable embodiment, the one or more fastening assemblies 16 are operationally configured to maintain the planar member 14 in abutment with the nut 12 to effectively seal the tank container 100 until the assembly 10 reaches a predetermined maximum temperature and/or until the pressure within the tank container 100 reaches a predetermined maximum level.

With particular reference to FIG. 2B, the one or more fastening assemblies 16 suitably include a bolt 16A, a block 16B for receiving the bolt 16A, and a temperature-sensitive fusible element 16C surrounding at least a portion of the block 16B. In one embodiment, the bolt 16A may be permanently attached to the block 16B once joined together. In another embodiment, the bolt 16A may be releasably attached to the block 16B, e.g., via a threaded connection. Suitably, the block 16B has a hole for receiving a bolt 16A there through whereby the bolt 16A and block 16B are operationally configured to hold the various assembly 10 components together during use of the assembly 10. In one embodiment, the block 16B comprises a threaded hole for receiving a threaded bolt 16A. In another embodiment, snap fit connections may be used to join the bolt 16A to the block 16B. In operation, with the assembly 10 in a sealed position with a vent nipple 101, the block 16B is operationally configured to receive the bolt 16A there through in a manner effective to maintain the planar member 14 in abutment with the nut 12.

Figure 3:
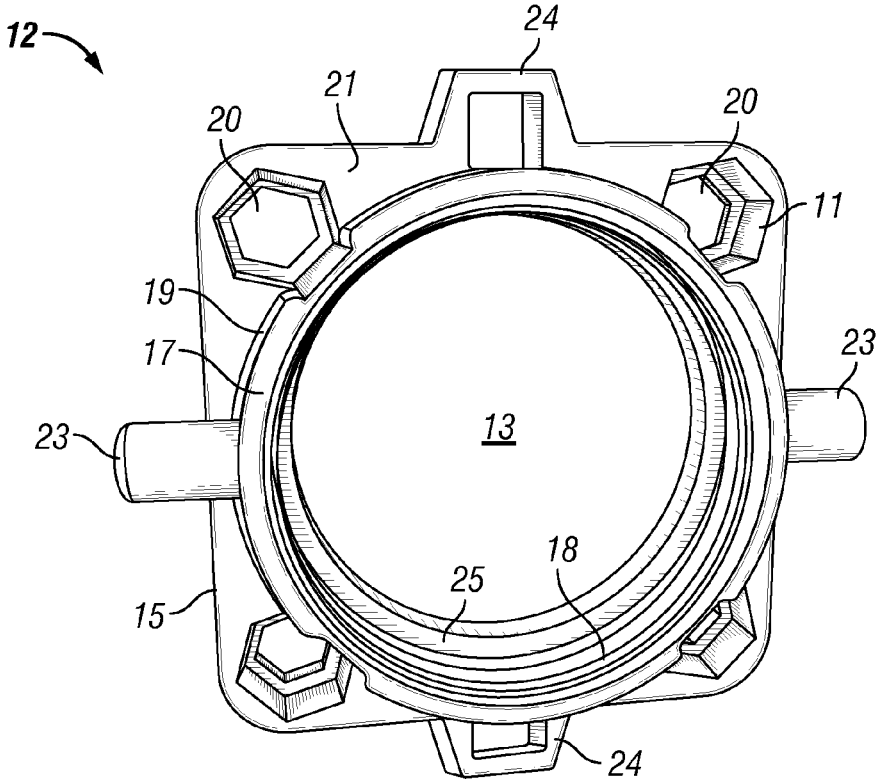
FIG. 3 is a perspective view of an embodiment of the inner surface of the nut member of the venting cap assembly.

Turning to FIG. 3, a suitable nut 12 includes a base 15 and a cylindrical component 17 that extends out from a first surface 21 of the base 15—the cylindrical component 17 having an inner mating surface 18 and an exterior surface 19. Although not limited to a particular configuration, a suitable nut 12 has a centrally located opening 13 there through. During assembly 10 operation when attached to a vent nipple 101, the cylindrical component 17 is defined by a central longitudinal axis substantially similar to the central longitudinal axis of a corresponding vent nipple 101.

As FIG. 3 illustrates, the inner mating surface 18 includes an annular threaded surface operationally configured to secure to a corresponding outer threaded portion of a vent nipple 101 as understood by persons of ordinary skill in the art of tank containers 100. Thus, the inner diameter of the inner surface 18 is substantially similar to the outer diameter of a corresponding nipple 101 and effective to form a seal there between. As further shown in FIG. 3, the inner mating surface 18 may include a seat 25 operationally configured to abut the outer edge of the vent nipple 101 when the nut 12 is secured to the vent nipple 101 during assembly 10 operation.

In other embodiments, it is also contemplated that the inner mating surface 18 may include a different surface configuration for securing to a non-threaded nipple 101 surface such as, but not necessarily limited to slotted connections, and snap on twist off tamper proof connections. Regardless of the type of attachment—the mating surfaces of the nut 12 and corresponding vent are suitably effective to form a seal there between.

Still referring to FIG. 3, the base 15 further includes one or more apertures 20 there through, each aperture 20 being located beyond the periphery of the exterior surface 19 of the cylindrical component 17. In addition, the first surface 21 of the base 15 suitably includes a cavity 11 at each aperture 20, each cavity 11 being operationally configured to receive at least part of a fastening assembly 16 therein. In particular, each cavity 11 suitably comprises an inner surface that corresponds to the outer surface of a corresponding fusible element 16C. In the simplified illustration of FIG. 3, the cavities 11 comprise hexagonal inner surfaces for receiving hexagonal fusible elements 16C therein although other shapes are contemplated herein. In one embodiment, the cavity 11, block 16B, fusible element 16C, and surface defining the aperture 20 may include a like shape. In another embodiment, the surface defining the aperture 20 and block 16B may comprise a shape different than the corresponding fusible element 16C.

As discussed further below, each fusible element 16C suitably includes a width greater than the inner width of the corresponding aperture 20, and each block 16B suitably includes a width less than the width of the corresponding aperture 20.

Figure 4:
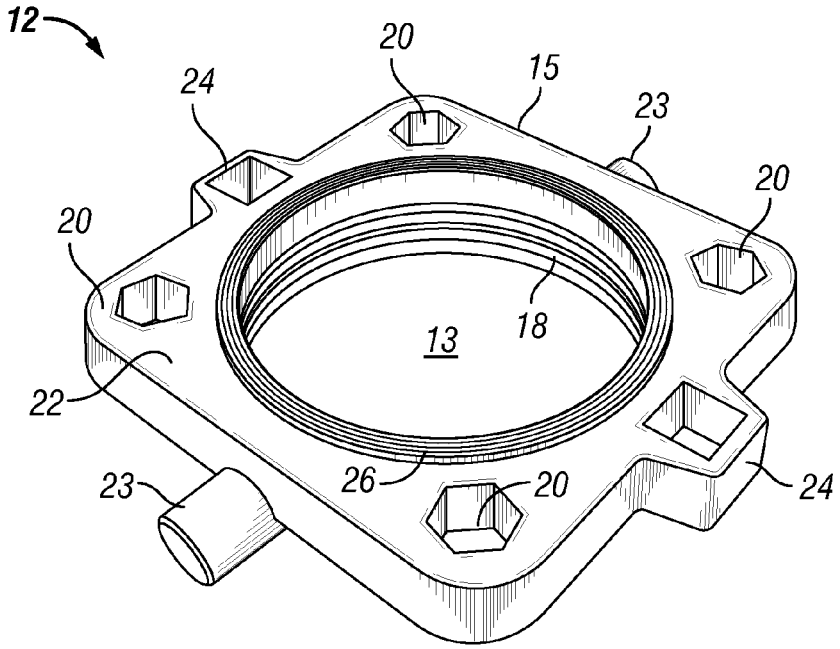
FIG. 4 is a perspective view of an embodiment of the outer surface of the nut member of the venting cap assembly.

Referring now to FIG. 4, the base 15 is further defined by an outer planar surface 22, the planar surface 22 being operationally configured to receive the planar member 14 in a manner effective to form an effective seal there between during assembly 10 operation. As desired, the nut 12 may also include one or more seal lugs operationally configured to provide a means for turning the nut 12 about a vent nipple 101. As shown, the nut 12 may include one or more solid lugs 23 and one or more open lugs 24 defined by apertures there through. In the event an individual cannot adequately turn a nut 12 about a vent nipple 101 by hand, a spanner wrench or other instrument may be employed for applying force to the one or more open lugs 24 to turn the nut 12 about a vent nipple 101. In addition, an individual may employ a hammer, wrench, or other object to strike or otherwise apply force to the one or more solid lugs 23 in a manner effective to turn the nut 12 about a vent nipple 101. For example, an individual may tighten the nut 12 to a target vent nipple 101 by hand followed by employing a hammer or other object to strike one or more solid lugs 23 and/or one or more open lugs 24 to further tighten the nut 12 to the vent nipple 101 to form a seal there between. Also, an individual may strike a solid lug 23 as necessary to loosen an already tightened nut 12 from a vent nipple 101. Although not necessarily limited to a particular surface configuration, a suitable solid lug 23 comprises a curved surface.

In transportation tank container applications, there is often times insufficient room to swing a hammer or like object. In addition, it may not always be desirable to strike at the assembly 10 and subject the assembly 10 to possible damage. Thus, an advantage of the present assembly 10 includes the one or more open lugs 24 that may be employed to turn a nut 12 under these conditions. Although the assembly 10 may be built to scale, a suitable nut 12 for tank container 100 applications includes one or more open lugs 24 with apertures there through effective to receive a standard drive socket, allowing for close quarters tightening and loosening of the nut 12 about a vent nipple 101 as understood by persons of ordinary skill in the art of tank containers. In one exemplary embodiment, the one or more open lugs 24 are operationally configured to receive a standard 12 mm or half-inch socket drive.

Figure 5:
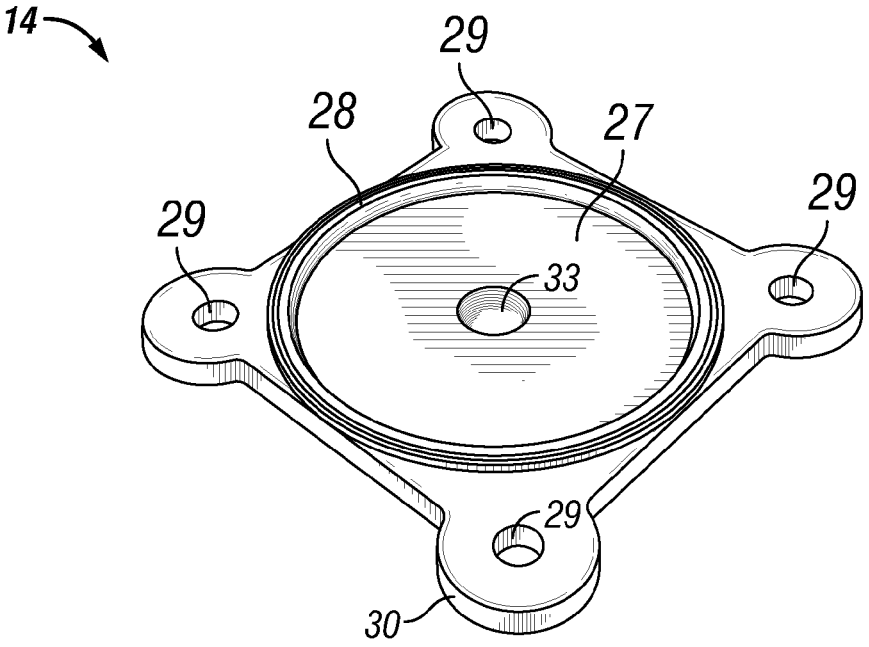
FIG. 5 is a perspective view of an embodiment of the inner surface of the planar member of the venting cap assembly.

As further depicted in FIG. 4, the planar surface 22 may include a raised landing 26 along the perimeter of the opening 13. The landing 26 suitably includes a surface configuration effective to form and maintain a seal with the planar member 14 during assembly 10 operation. In one particularly advantageous embodiment, the landing 26 is defined by a plurality of ribbed or grooved portions encircling the opening 13 of the nut 12. As shown in FIG. 5, the inner surface 27 of the planar member 14 may also include a raised landing 28 like the landing 26 of the nut 12. Regardless of landing 26, 28 configurations employed, mating surfaces of the landings 26, 28 are suiably operationally configured to form and maintain a seal up to 360 degrees along the perimeter of the opening 13.

Suitably, the planar member 14 includes a length and width substantially similar to the planar surface 22 of the nut 12. The planar member 14 also includes one or more apertures 29 operationally configured to align with corresponding apertures 20 of the nut 12. As discussed further below, each aperture 29 is suitably sized to receive part of a fastening assembly 16 there through.

Figure 6:
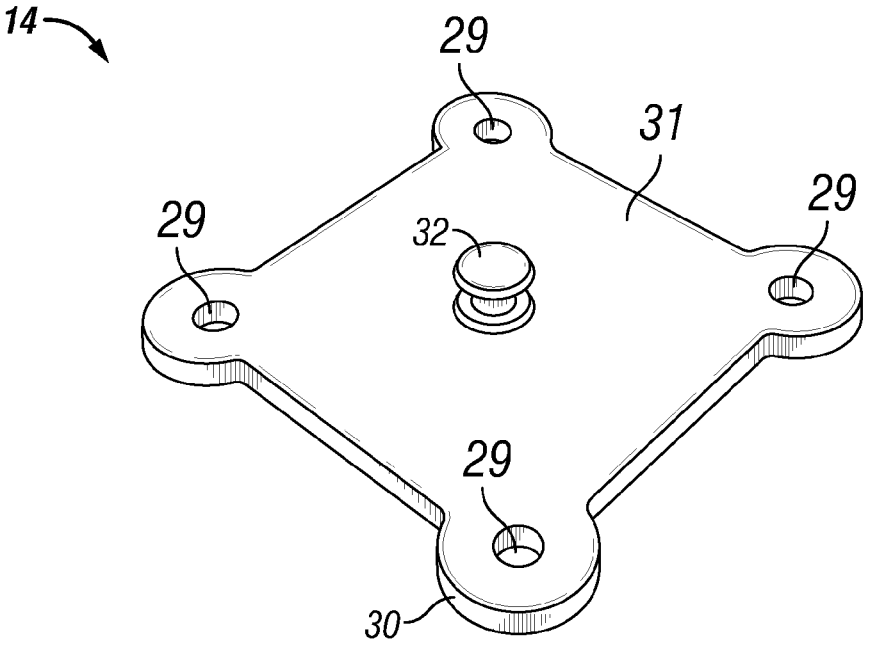
FIG. 6 is a perspective view of an embodiment of the outer surface of the planar member of the venting cap assembly.

The planar member 14 may comprise a substantially rectangular configuration. As shown in FIGS. 5 and 6, the planar member 14 may include projections 30 at the apertures 29—this particular configuration of the planar member 14 minimizing the weight of the assembly 10 by reducing amount of material used to construct the planar member 14.

FIG. 6 depicts a simplified embodiment of the outer surface 31 of the planar member 14. Unlike the planar member 14 represented in FIG. 2, here the planar member 14 includes a handle 32 type component operationally configured to assist in handling or otherwise manipulating the planar member 14 as desired. The handle 32 is not necessarily limited to a particular configuration however, industry standards, manufacturing costs, size constraints, and weight concerns may dictate the ultimate assembly 10 design and handle 32 configuration. In addition, the handle 32 may be solid or hollowed out as depicted in FIG. 5 providing a cavity 33 along the inner surface of the planar member 14.

Figure 7:
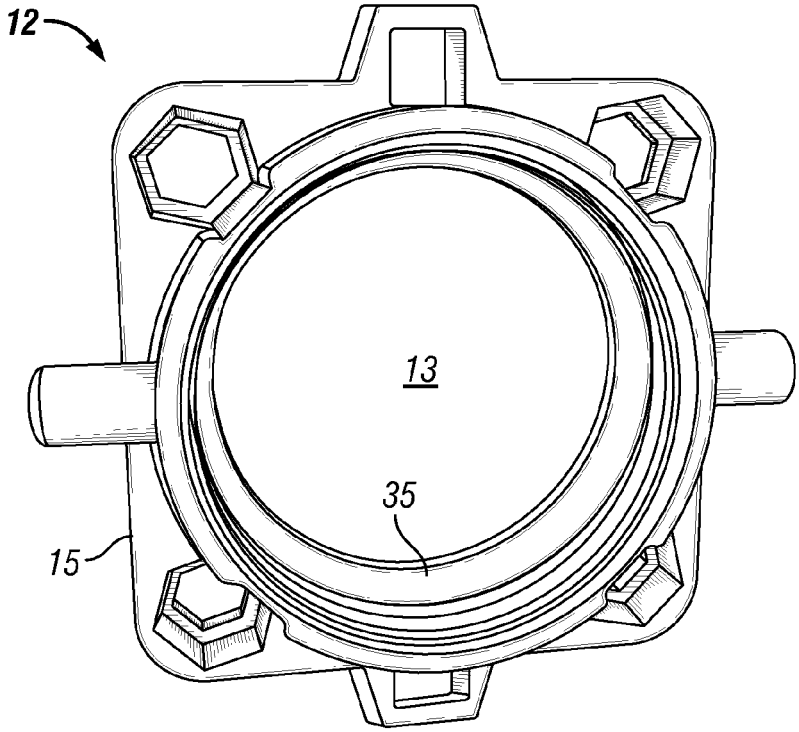
FIG. 7 is a perspective view of an embodiment of the inner surface of the nut member of the venting cap assembly including a seal member disposed along the inner periphery of the nut member.

As FIG. 7 shows, the assembly 10 may include one or more additional means for forming and maintaining a seal. In particular, the assembly 10 may include one or more seal members 35 set adjacent the seat 25 and operationally configured to prevent passage of fluid past the seat 25 of the inner surface 18. Suitable seal members 35 include, but are not necessarily limited to O-rings and gasket material. One particularly advantageous seal member 35 may include a polytetrafluoroethylene (PTFE) gasket or equivalent.

Figure 8:
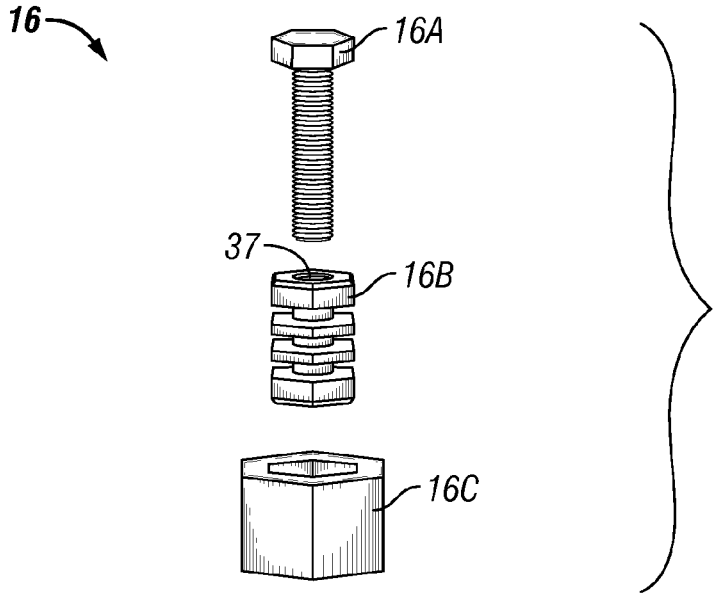
FIG. 8 is an exploded view of an embodiment of the fastening assembly.

Turning now to the fastening assembly 16, one exemplary embodiment is depicted in FIG. 8. As shown, the bolt 16A may include a threaded hexagon head bolt. Other bolt configurations may be used as desired including, but not necessarily limited to square bolts, round-head square-neck bolts, countersunk bolts, and round-head bolts. In addition, other types of fastening members may be used. For example, a threaded male screw may be employed as desired.

Suitably, the bolt 16A is operationally configured to securely mate with the block 16B. In one embodiment, the bolt 16A and block 16B may be permanently secured once mated. In another embodiment, the bolt 16A may be releasably secured to the block 16B in a manner effective to disassemble the fastening assembly 16 as desired. For example, in an embodiment including a threaded bolt 16A the corresponding block 16B suitably includes a mating hole 37 having a threaded inner surface allowing the bolt 16A to be both threaded to and unthreaded from the block 16B.

Although not necessarily limited to a particular configuration, the outer surface of the block 16B is effective to receive and maintain a fusible element 16C thereto. In one embodiment, the block 16B may comprise a cylindrical type outer surface configuration. In another embodiment, the block 16B may comprise a multi-sided outer surface configuration. As depicted in FIG. 8, the block 16B may include an irregular outer surface configuration increasing the available surface area for adherence of a fusible element 16C thereto.

A suitable fusible element 16C may be constructed from a polymer material effective to maintain its original shape up to temperatures of about 121° C. (about 250° F.). In a particularly advantageous embodiment, the fusible element 16C may be constructed from polymeric materials including, but not necessarily limited to chemically inert thermoplastic polymers, high density polyethylenes, and combinations thereof. Although not necessarily limited to a particular mode of operation, a suitable fusible element 16C is formed via injection molding surrounding the block 16B whereby the block 16B and fusible element 16C may be provided as a one piece "pre-formed member."

With reference again to FIG. 2A, the mode of assembly of the various components of the fastening assembly 16 are shown. Although the sequence of assemblage may vary, a simplified mode includes placing the inner surface 27 of the planar member 14 against the planar surface 22 of the base 15 in a manner effective to align the apertures 29 of the planar member 14 with the apertures 20 of the nut 12. Thereafter, one or more pre-formed member may be placed within desired cavities 11 of the nut 12. Bolts 16A may then be directed through the apertures 29 of the planar member 14 and apertures 20 of the base 15 to mate with the block 16B. In an embodiment including threaded connections, the bolt 16A is suitably screwed into the block 16B thereby tightening the planar member 14 to the nut 12. Once assembled, the assembly 10 may be screwed onto a target vent nipple 101 of a tank container 100. Once the assembly 10 is secured to the nipple 101 of a tank container 100, the planar member 14 is suitably held in sealable abutment to the nut 12 via the one or more fastening assemblies 16 until the assembly 10 reaches a predetermined maximum temperature as determined by the materials of construction of the fusible element 16C.

Figure 9A:
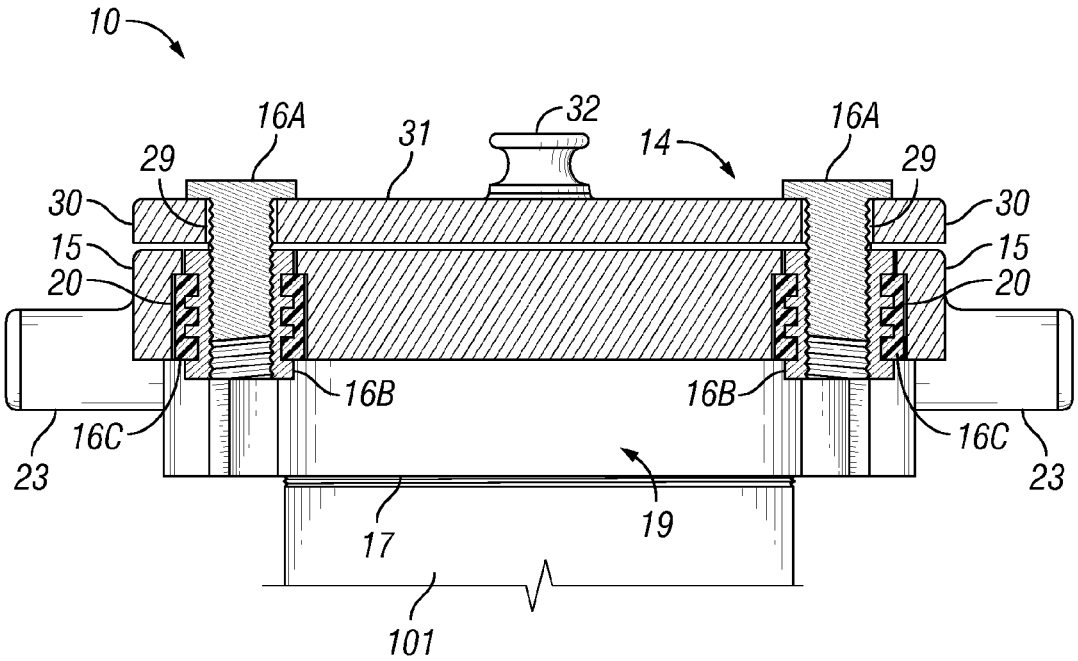
FIG. 9A is a side view of an embodiment of an assembled venting cap assembly in a sealed configuration with a tank container.

As stated previously, each fusible element 16C suitably includes a width greater than the width of the corresponding apertures 20 of the nut 12, and each block 16B suitably includes a width less than the width of the corresponding apertures 20. As shown in FIG. 9A, once the bolt 16A is fastened to the block 16B, the corresponding fusible element 16C is operationally configured to prevent passage of the bolt 16A and block 16B out through the aperture 20 away from the fusible element 16C.

Figure 9B:
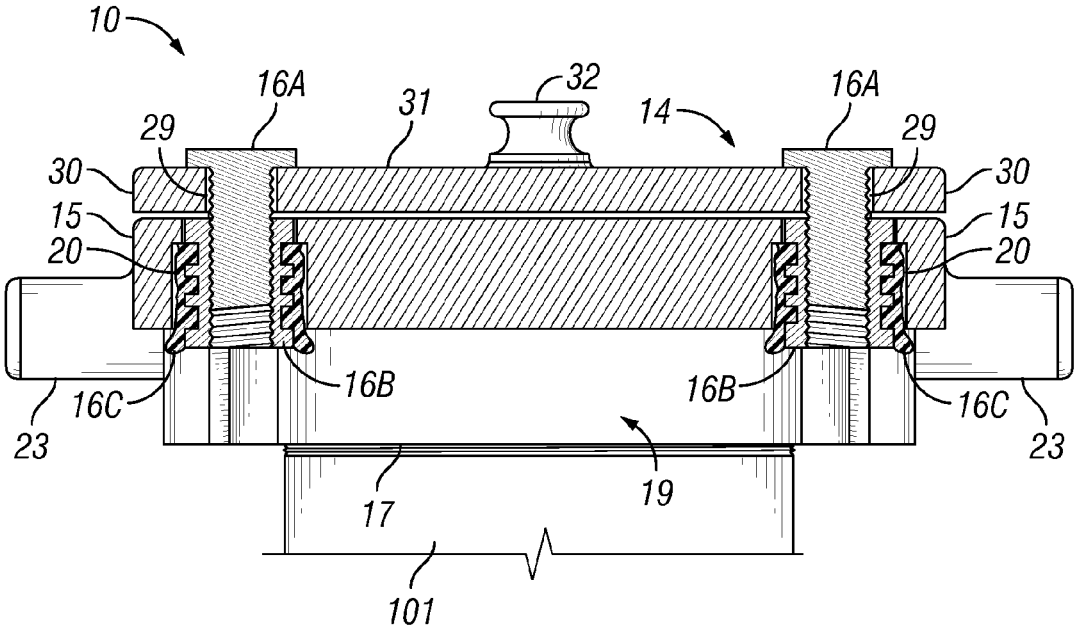
FIG. 9B is a side view of the embodiment of FIG. 9A depicting the fusible elements of the fastening assemblies deforming due to external heat.
Figure 9C:
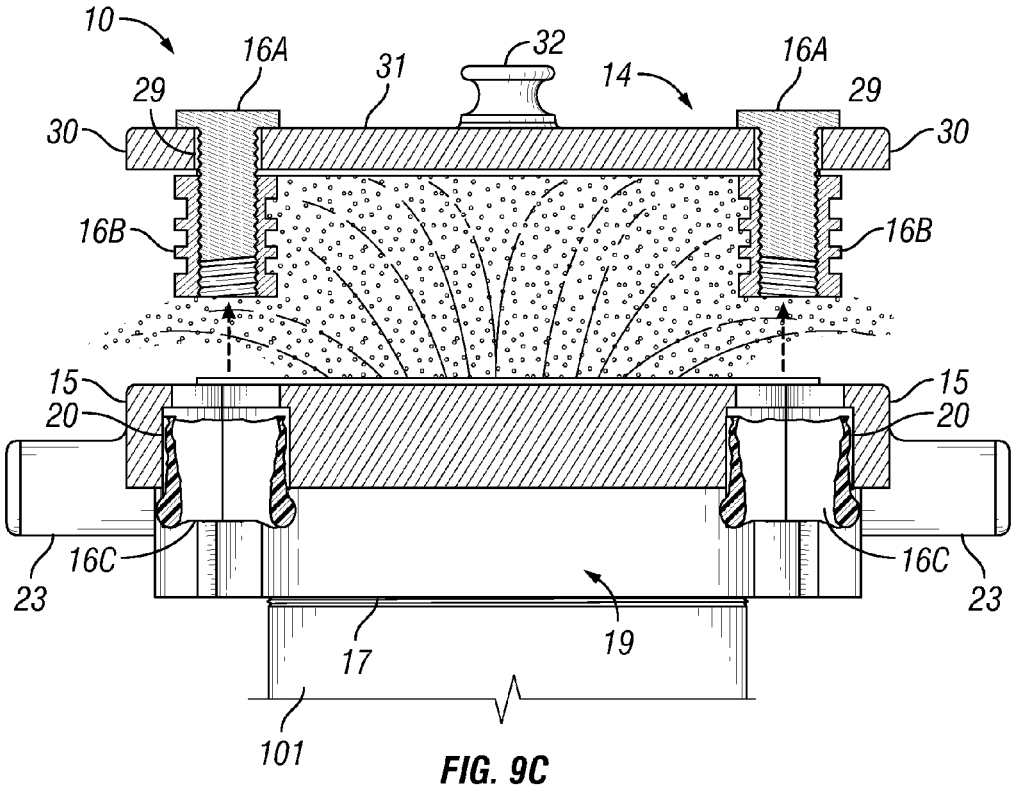
FIG. 9C is a side view of the embodiment of FIG. 9B illustrating the release of the planar member from the nut member during venting of the corresponding tank container.

Turning to FIG. 9B, as the assembly 10 reaches a predetermined maximum temperature for assembly 10 operation, the fusible elements 16C suitably begin to fuse or melt thereby deforming the fusible elements 16C within the corresponding cavities 11 of the nut 12. Once the fusible elements 16C have melted, softened, or otherwise deformed in a manner effective to (1) detach from the blocks 16B, or (2) flow out of the apertures 20, fluid pressure from within the tank container 100 may then remove, i.e., blow out, the planar member 14, bolts 16A, and blocks 16B out apart from the nut 12 as shown in FIG. 9C. Thereafter, the planar member 14 may be reassembled to the nut 12 using one or more new fastening assemblies 16, or at least the original bolts 16A with new pre-formed members.

Figure 10A:
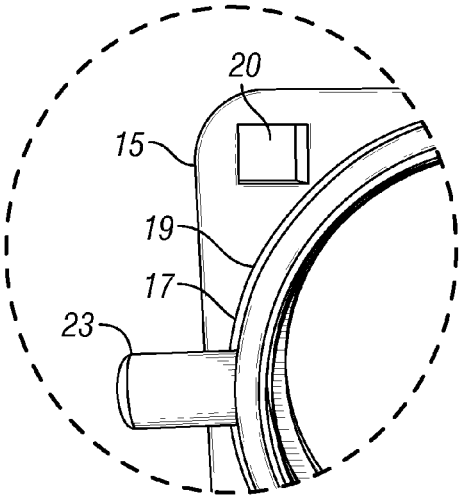
FIG. 10A is a detailed view of one embodiment of a nut member aperture operationally configured to receive a fastening assembly.
Figure 10B:
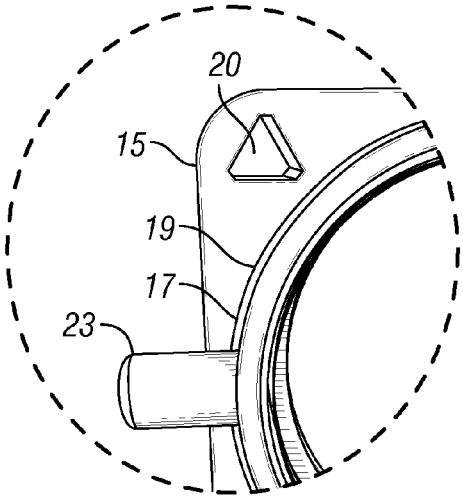
FIG. 10B is a detailed view of another embodiment of a nut member aperture operationally configured to receive a fastening assembly.
Figure 11:
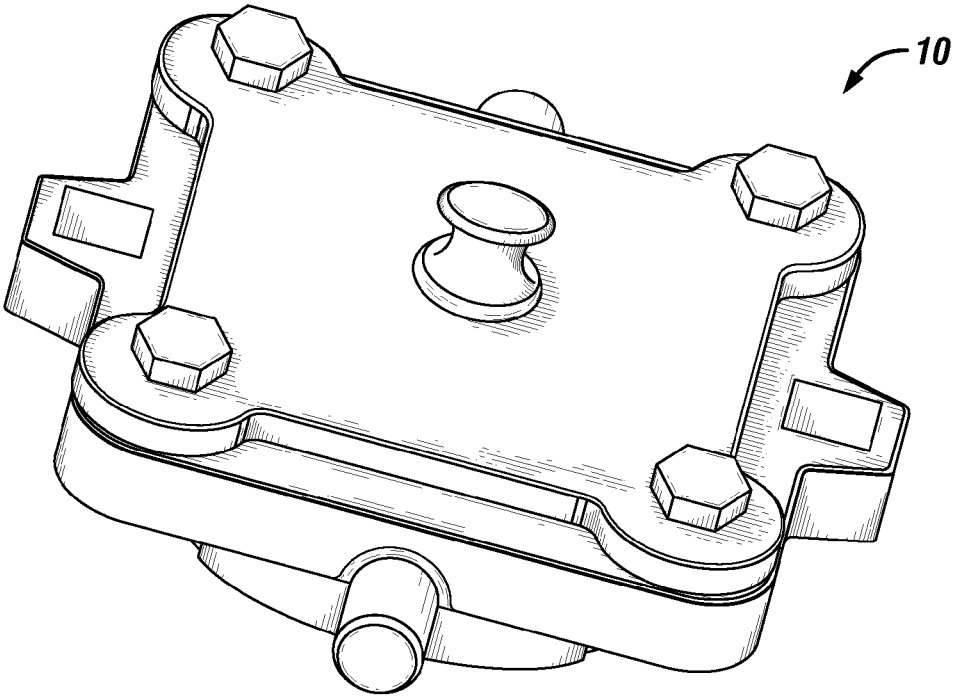
FIG. 11 is a top perspective view of an embodiment of the venting cap assembly.
Figure 12:
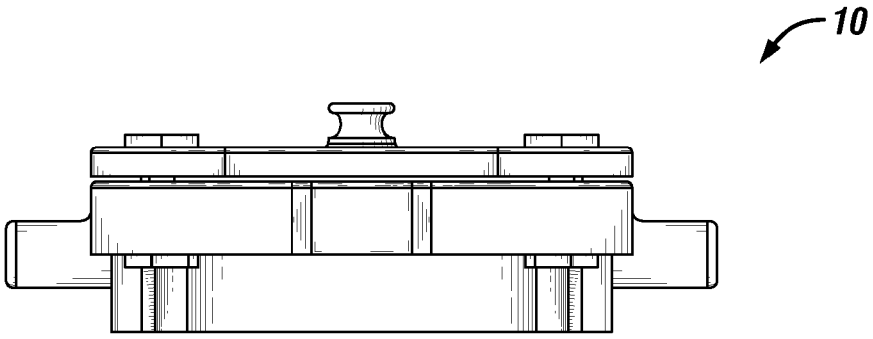
FIG. 12 is a front view of an embodiment of the venting cap assembly.

In one embodiment, the surface configuration of the blocks 16B may correspond to the shape of the apertures 20. For example, in the embodiment of FIGS. 3-4 the apertures 20 are hexagonal and correspond in shape to hexagonal blocks 16B. In another embodiment the apertures 20 may have shapes differing from the corresponding blocks 16B while still enabling the blocks 16B to travel through the apertures 20 during venting of the tank container 100 as depicted in FIG. 9C. For example, the apertures 20 may comprise rectangular apertures 20 (FIGS. 10A) or triangular apertures 20 (FIGS. 10B). The apertures 20 may also have irregular shapes, circular shapes, oval shapes, or other multi-sided shapes as desired.

The assembly 10 described herein may be constructed from one or more materials durable enough to seal fluids at a vent nipple 101. In particular, the assembly 10 may be constructed from materials, including but not necessarily limited to, materials resistant to chipping, cracking, and breaking as a result of ozone, weathering, heat, moisture, other outside mechanical and chemical influences, as well as violent physical impacts. Suitable nut 12 and planar member 14 materials include, but are not necessarily limited to relatively high thermal conductive materials including composite materials, ferrous metals, non-ferrous metals, and combinations thereof. Suitable metals include steel, aluminum, malleable iron, and combinations thereof. In one embodiment, the nut 12 and planar member 14 may be constructed from stainless steel. In one particularly advantageous embodiment, the nut 12 and planar member 14 may be constructed from 316 stainless steel. In another particularly advantageous embodiment, the nut 12 and planar member 14 may be constructed from 304 stainless steel. In still another embodiment, the nut 12 may be constructed from 316 stainless steel and the planar member 14 may be constructed from 304 stainless steel—or vice versa. In yet another embodiment, the nut 12 and planar member 14 may be constructed from one or more materials effective for use with a tank container storing fluids reaching temperatures up to about 210° C. (about 410° F.).

The nut 12 and planar member 14 may be produced by various processes including, for example, die casting, welding, and investment casting via the lost wax process. In a particularly advantageous embodiment, the nut 12 and planar member 14 are investment casted via the lost wax process, which is suitable for eliminating the problems associated with welding including, for example, rust, corrosion, and material deformation.

Suitably, the assembly 10 includes a design and materials of construction effective to withstand brief exposure to high pressures up to about 21.1 $Kg/cm^2$ (about 300 PSI) during assembly 10 operation. Although not necessarily limited to any particular safety features, a maximum service pressure of the assembly 10 in connection with tank containers 100 may be up to about 5.3 $Kg/cm^2$ (about 75 PSI).

Figure 13:
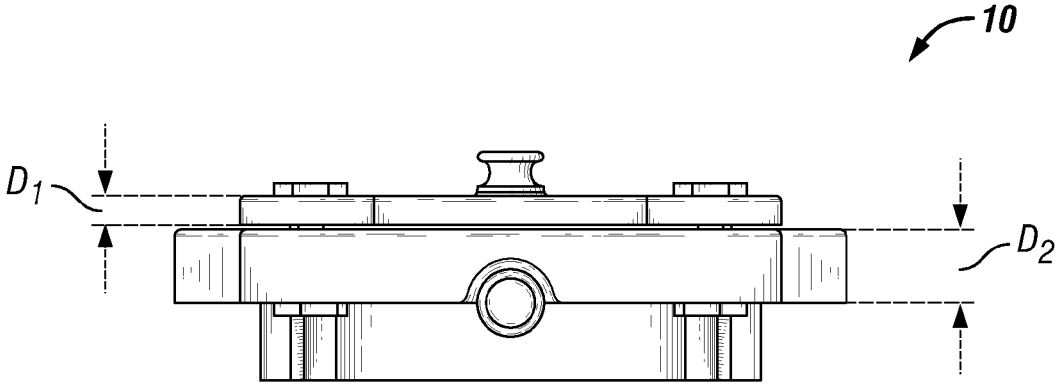
FIG. 13 is a side view of an embodiment of the venting cap assembly.
Figure 14:
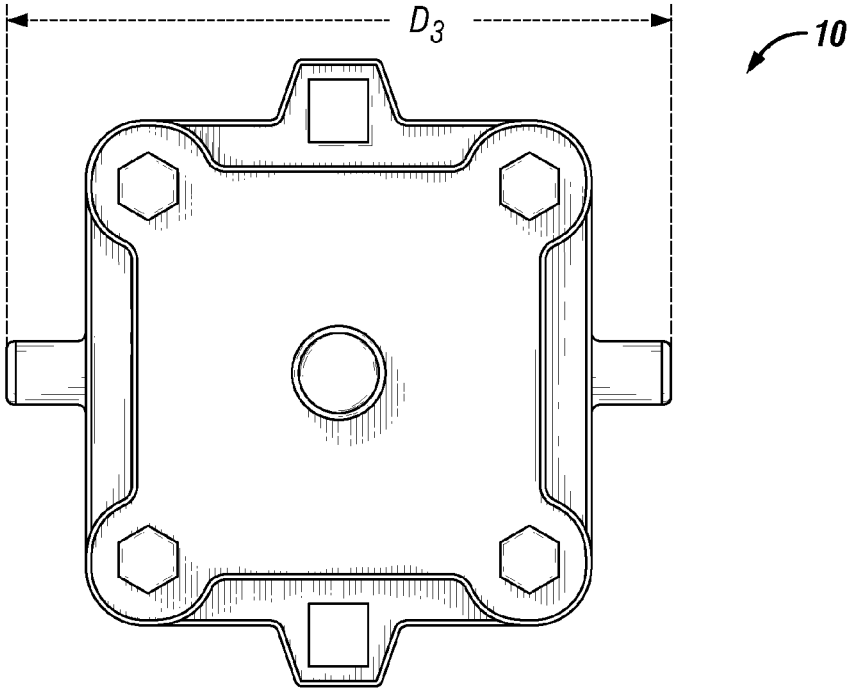
FIG. 14 is a top view of an embodiment of the venting cap assembly.
Figure 15:
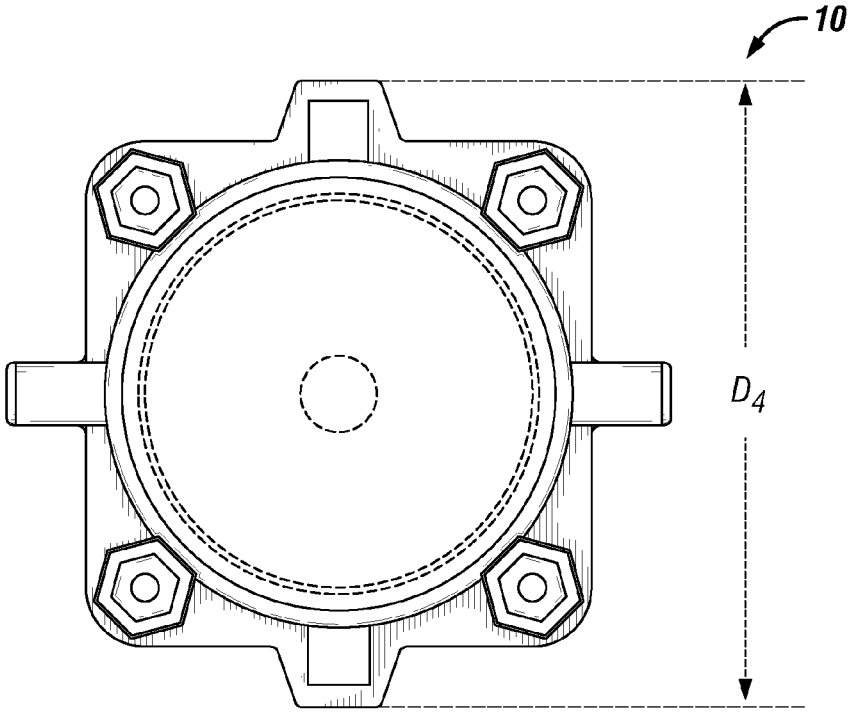
FIG. 15 is a bottom view of an embodiment of the venting cap assembly.

As stated previously, the assembly 10 may be built to scale and is not necessarily limited to a particular size or weight. With reference to FIGS. 13-15, an assembly 10 configured for use with a tank container 100 suitably includes the following parameters listed in Table 1 below:

TABLE 1

| | |
|---|---|
| D1: | about 0.5 cm (about 0.20 inches) |
| D2: | about 1.4 cm (about 0.6 inches) |
| D3: | about 14.0 cm (about 5.5 inches) |
| D4: | about 13.5 cm (about 5.3 inches) |

The invention will be better understood with reference to the following non-limiting example, which is illustrative only and not intended to limit the present invention to a particular embodiment.

EXAMPLE 1

In a first non-limiting example, a stainless steel assembly 10 as provided in FIGS. 11-15 is manufactured to a weight of about 1.2 kg (about 2 lb 10 oz).

Persons of ordinary skill in the art will recognize that many modifications may be made to the present application without departing from the spirit and scope of the application. The embodiment(s) described herein are meant to be illustrative only and should not be taken as limiting the invention, which is defined in the claims.

I claim:

1. An assembly for sealing an opening of a container, comprising:

a first member operationally configured to connect to the container at the opening;

a second member operationally configured to abut the first member in a manner effective to cover the opening of the container; and a temperature-sensitive fastening means operationally configured to releasably secure the second member to the first member in a manner effective to form a seal there between;

wherein at least part of the fastening means is positioned apart from the second member;

wherein the first member has an opening there through, the opening of the first member having an inner diameter substantially similar to the outer diameter of the opening of the container; and wherein the first member has one or more apertures, each aperture being operationally configured to receive at least part of the fastening means there through.

2. The assembly of claim 1 wherein the first member has a centrally located opening there through.

3. The assembly of claim 1, wherein the second member has one or more apertures there through, the one or more apertures of the second member being operationally configured to align with corresponding apertures of the first member for receiving at least part of the fastening means there through.

4. The assembly of claim 1 wherein the temperature-sensitive fastening means includes one or more fastening assemblies each having a fusible element constructed from a polymeric material effective to maintain its original shape up to temperatures of about 121° C.

5. The assembly of claim 4 wherein the polymeric material is selected from the group consisting of chemically inert thermoplastic polymers, high density polyethylenes, and combinations thereof.

6. The assembly of claim 1 wherein part of the temperature-sensitive fastening means is constructed from a polymeric material selected from the group consisting of chemically inert thermoplastic polymers, high density polyethylenes, and combinations thereof.

7. An assembly for sealing an opening of a container, comprising:

a first member operationally configured to connect to the container at the opening;

a second member operationally configured to abut the first member in a manner effective to cover the opening of the container; and a temperature-sensitive fastening means operationally configured to releasably secure the second member to the first member in a manner effective to form a seal there between;

wherein at least part of the fastening means is positioned apart from the second member; and wherein the temperature-sensitive fastening means are located beyond the periphery of the opening of the container when the assembly is connected to the container.

8. The assembly of claim 1, wherein at least a part of the temperature-sensitive fastening means includes a width greater than the inner width of the corresponding aperture of the first member.

9. An assembly for venting a fluid container, comprising:

a first member operationally configured to connect to a vent nipple of the container;

a second member operationally configured to cover the vent nipple; and one or more temperature-sensitive fasteners including yieldable members, the fasteners being operationally configured to releasably secure the second member to the first member in a manner effective to form a seal at the vent nipple, the yieldable members being positioned apart from the second member:, wherein each of the temperature-sensitive fasteners includes a bolt, a block for receiving the bolt, and a temperature-sensitive fusible element surrounding at least a portion of the block.

10. The assembly of claim 9 wherein the first member has an annular threaded surface for connecting to the vent nipple.

11. The assembly of claim 9 wherein the first member and second member have corresponding apertures, the apertures of the first member having an inner width less than the width of corresponding temperature-sensitive fusible elements and greater than the width of corresponding blocks.

12. A method of venting a fluid container, comprising the following steps:

providing an assembly including (1) a first member operationally configured to connect to a vent nipple of the container, (2) a second member operationally configured to abut the first member and cover the vent nipple, and (3) a first set of one or more temperature-sensitive fastening assemblies operationally configured to secure the second member to the first member in a manner effective to form a seal there between thereby sealing the vent nipple; each of the one or more temperature-sensitive fastening assemblies having a fusible member constructed from a polymeric material effective to maintain its original shape up to a maximum predetermined temperature, each fusible member being positioned apart from the second member wherein the temperature-sensitive fastening assemblies are located beyond the periphery of the opening of the container when the assembly is connected to the container;

connecting the assembly to a vent nipple of a fluid container to seal the vent nipple, wherein once the temperature of the assembly goes above the maximum predetermined temperature, the pressure of the fluid container is effective to remove the second member from the first member, the first member maintaining its connected orientation with the vent nipple; and placing the second member in abutment with the first member and sealing the vent nipple via a second set of one or more temperature-sensitive fastening assemblies.

* * * * *